US005464009A

United States Patent [19]

Tatarek-Gintowt

[11] Patent Number: 5,464,009

[45] Date of Patent: Nov. 7, 1995

[54] VALVE FOR USE IN BREATHING APPARATUS

[75] Inventor: Andrew R. T. Tatarek-Gintowt, Aldershot, England

[73] Assignee: Sabre Safety Limited, Aldershot, England

[21] Appl. No.: 189,609

[22] Filed: Feb. 1, 1994

[30] Foreign Application Priority Data

Feb. 1, 1993 [GB] United Kingdom ..... 9301959

[51] Int. Cl.[6] ..... A62B 9/02

[52] U.S. Cl. ..... 128/205.24; 128/204.26

[58] Field of Search ..... 128/204.26, 205.24; 137/494

[56] References Cited

U.S. PATENT DOCUMENTS

| | | | |
|---|---|---|---|
| 2,563,228 | 8/1951 | Ensign | 137/494 |
| 3,272,143 | 9/1966 | Rice | 137/494 |
| 3,285,261 | 11/1966 | Chaney | 128/204.26 |
| 3,474,812 | 10/1969 | Robertson | 128/204.26 |
| 3,716,053 | 2/1973 | Almovist et al. | 128/204.26 |
| 3,952,773 | 4/1976 | Hahn | 128/204.26 |
| 3,974,851 | 8/1976 | Garretson | 137/494 |
| 4,106,510 | 8/1978 | Hakim et al. | 137/494 |
| 4,266,538 | 5/1981 | Ruchti | 137/494 |
| 4,289,126 | 9/1981 | Seireg et al. | 128/204.26 |
| 4,411,285 | 10/1983 | Oswell | 128/204.26 |
| 4,572,176 | 2/1986 | Walther | 128/204.26 |
| 4,821,767 | 4/1989 | Jackson | 128/204.26 |
| 4,850,345 | 7/1989 | Jackson | 128/205.24 |
| 5,016,627 | 5/1991 | Dahrendorf et al. | 128/205.24 |
| 5,245,997 | 9/1993 | Bartos | 128/205.24 |
| 5,357,950 | 10/1994 | Wippler et al. | 128/205.24 |

FOREIGN PATENT DOCUMENTS

| | | |
|---|---|---|
| 796336 | 6/1958 | United Kingdom . |
| 1019986 | 2/1966 | United Kingdom . |
| 2075848 | 11/1981 | United Kingdom . |
| 2190001 | 11/1987 | United Kingdom . |
| 2195900 | 4/1988 | United Kingdom . |
| 2234368 | 1/1991 | United Kingdom . |
| 2239328 | 6/1991 | United Kingdom . |

*Primary Examiner*—Edgar S. Burr
*Assistant Examiner*—Aaron J. Lewis
*Attorney, Agent, or Firm*—Bacon & Thomas

[57] ABSTRACT

A demand value for use in breathing apparatus, and comprising a housing 1 in which is mounted a diaphragm 2 such as to divide the interior of the housing into two separate chambers 3,4. Chamber 4 is vented to atmosphere through a hole 14; chamber 3 is connected via a pipe 13 to a gas outlet whereby breathing gas may be supplied to a face piece or mask for a user. Breathing air is supplied from a main gas supply channel 8 via a main valve 9,10 to a gas supply channel 6. A gas inlet channel 5 connects the supply channel 6 to the chamber 3 under the control of a needle valve 11 which closes an orifice 7. The head 11B of the needle valve is urged by a spring (not shown) into contact with the diaphragm 2 and thus the movement of the diaphragm controls the opening and closing of the needle valve. The diaphragm 2 is pivoted about spaced pivot members 15, and leaf springs 16 are used to maintain the diaphragm in contact with the pivot members 15. A leaf spring 17 acts to push the diaphragm about the pivot members in a direction such as to tend to close the needle valve 11.

18 Claims, 3 Drawing Sheets

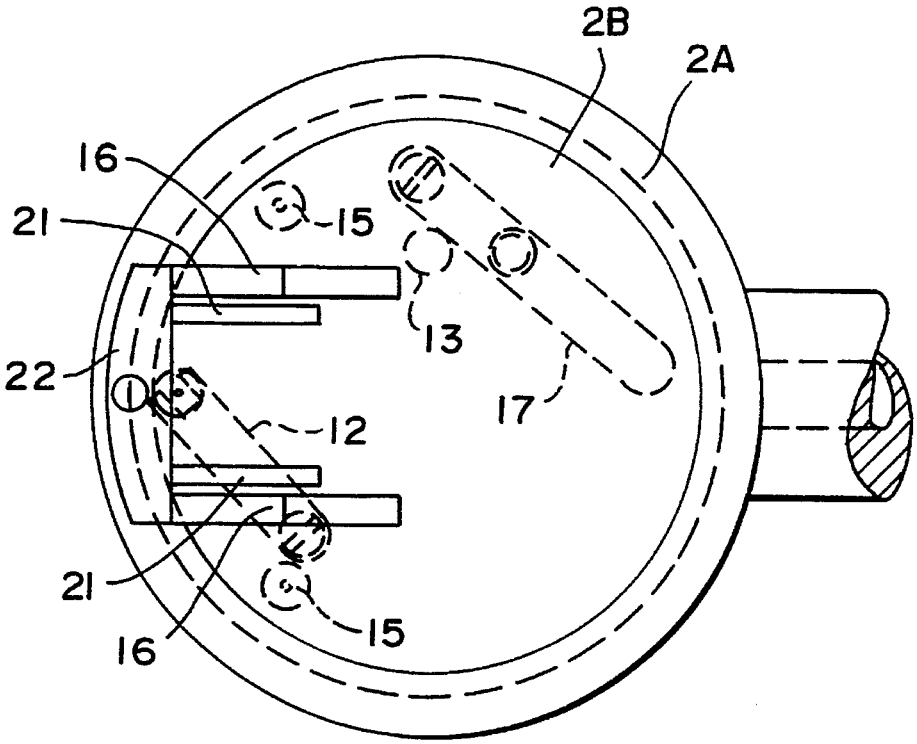
FIG. 2
FIG. 3
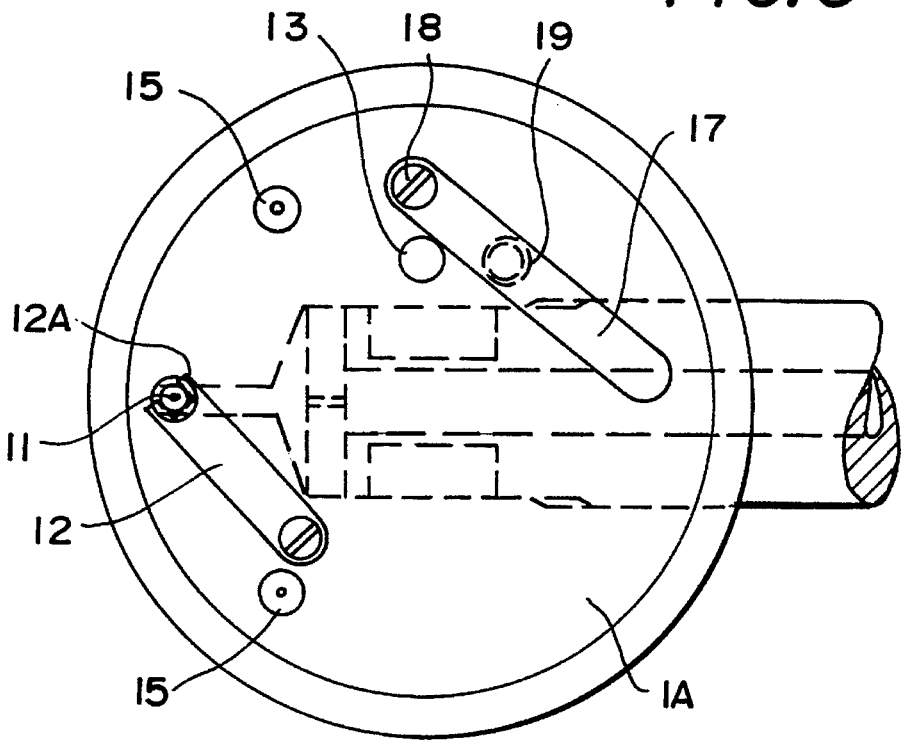

VALVE FOR USE IN BREATHING APPARATUS

BACKGROUND OF THE INVENTION

This invention relates to a valve for use in breathing apparatus and more particularly to a demand valve.

From U.K. Patents Nos. 2 190 001, 2 195 900, 2 234 368 and 2 239 328 there is known a valve for use in breathing apparatus which includes a housing having a diaphragm mounted therein to define with the housing two chambers, a first one of which has a gas inlet for receiving breathing gas and a gas outlet through which breathing gas may be supplied to a face piece or mask for a user. The second chamber includes pivot means eccentrically mounted such that the diaphragm is pivoted at a position between its center of gravity and the gas inlet to the first chamber. The second chamber is vented direct to atmosphere, and , when a pressure sufficiently greater than atmospheric pressure is present in the first chamber, the diaphragm is pivoted to close the gas inlet against the pressure of the inflowing gas. A reduction of pressure in the first chamber when inhalation commences causes the diaphragm to pivot away from the gas inlet and allow gas to flow into the first chamber.

The known valve as described in outline above may be a demand valve per se or may be a pilot valve used in conjunction with a main valve as a pilot-operated demand valve. The first chamber of the known valve may additionally include spring means located at or near the gas inlet, the spring means exerting a biasing force on the diaphragm to ensure that the closing pressure required in the first chamber for pivoting the diaphragm to close the gas inlet is always sufficiently greater than the atmospheric pressure. Such a biasing spring is usually employed when the valve is a pilot valve and the pressure exerted on the diaphragm is a low pressure resulting from the small gas inlet to the first chamber which is the pilot jet.

The valves described in the aforesaid patents are all positive pressure valves because the pressure required in the first chamber to close the gas inlet is always greater than atmospheric pressure as discussed above. Positive pressure valves are used in protective respiratory systems where the user is isolated from the atmosphere by a face mask or other sealing means, and the positive pressure in the system ensures that any leakage past the sealing means is leakage from the protective system to atmosphere. However, in other applications, for example medical demand regulators, the outlet of the demand regulators is open to atmosphere for a substantial part of the time and if a valve according to the aforesaid patents were to be used for such an application, the positive pressure valve would deliver unrestricted flow to atmosphere.

Accordingly medical demand regulators require a negative pressure demand valve. The obvious modifications to the valve of the aforesaid U.K. patents in order to make this valve a negative pressure demand valve are either non-operative or unsatisfactory. In particular changing of the position of the spring in the first chamber to the opposite side of the pivot to the gas inlet will result in the pivot becoming inoperative, the reduction of pressure in the first chamber on inhalation simply sucking the diaphragm away from the pivot, and the gas inlet remaining closed. The same result will occur if the spring is positioned on the same side of the pivot as the gas inlet but on the opposite side of the diaphragm.

A further alternative possibility for making the valve of the aforesaid patents into a negative pressure demand valve is to change the positions of the pivot and the spring to the opposite sides of the diaphragm so that the pivot is in the first chamber and the spring is in the second chamber on the same side of the pivot as the gas inlet. Such a modification will not function satisfactorily since the normal level of pressure above atmospheric experienced during exhalation and communicated to the first chamber would lift the diaphragm off the pivot.

SUMMARY OF THE INVENTION

According to the present invention there is provided a valve for use in breathing apparatus comprising a housing, a diaphragm mounted within the housing and, together with the housing, defining a first chamber on one side of the diaphragm and a second chamber on the other side of the diaphragm, a gas inlet to the first chamber, a gas outlet from the first chamber, vent means in the housing connecting the second chamber to ambient atmosphere, pivot means in the first chamber for engaging the diaphragm on a pivot axis between the center of gravity of the diaphragm and the gas inlet, first spring means mounted to the housing within the second chamber and extending into engagement with the opposite side of the diaphragm to the pivot means and applying to the diaphragm a force directed toward the pivot axis to maintain the diaphragm in engagement with the pivot means, and further spring means mounted to the housing and extending into the first chamber into contact with the diaphragm at a position on the opposite side of the pivot means to the gas inlet and urging the diaphragm to pivot so that the part of the diaphragm on the same side of the pivot means as the gas inlet is moved in a direction to close the gas inlet whereby the gas inlet is closed by the diaphragm at a pressure below atmospheric pressure.

Conveniently a valve according to the present invention further includes adjustment means for adjusting the further spring means to vary the moment about the pivot exerted by the further spring means, and so to adjust the opening pressure of the valve (i.e. the pressure in the first chamber at which the diaphragm will start to pivot away from the gas inlet to allow gas to flow into the first chamber from the gas inlet).

The provision of adjustment means enables a valve in accordance with the present invention to be manufactured to substantially lower manufacturing tolerances than are required if a valve according to the aforesaid U.K. Patents is to be manufactured to provide an opening pressure within acceptable limits.

The provision of adjustment means for the further spring means enables a valve in accordance with the present invention to be operated at a wide range of negative pressures. The adjustment means may enable the valve according to the present invention to be converted from a negative pressure demand valve to a positive pressure demand valve acting at a range of positive pressures.

The spring means employed in a valve according to the present invention may be helical compression springs. However, in the preferred embodiment of the present invention the first spring means is a first leaf spring means. Advantageously the further spring means is a further leaf spring means.

When the further spring means is a further leaf spring means, the adjustment means conveniently comprises a screw located in the housing and acting on the further leaf spring means at a position between the mounting of the further leaf spring means to the housing and the contact of the further leaf spring means with the diaphragm.

Preferably a valve according to the present invention includes additional spring means, advantageously additional leaf spring means, mounted to the housing within the second chamber and extending into contact with the diaphragm at a position on the opposite side of the pivot means from the gas inlet.

The first spring means and additional spring means may conveniently be combined in a single part comprising a common base member and two twin leaf springs extending therefrom, one twin leaf spring being the first spring means and the other twin leaf spring being the additional spring means.

In accordance with a preferred embodiment of the present invention there is provided a valve for use in breathing apparatus comprising a housing, a diaphragm mounted within the housing and, together with the housing, defining a first chamber on one side of the diaphragm and a second chamber on the other side of the diaphragm, a gas inlet to the first chamber, a gas outlet from the first chamber, vent means in the housing connecting the second chamber to ambient atmosphere, pivot means in the first chamber for engaging the diaphragm on a pivot axis between the center of gravity of the diaphragm and the gas inlet, V-shaped leaf spring means mounted to the housing within the second chamber such that the apex of the V-shaped leaf spring means contacts the diaphragm at a position in the second chamber opposite to the pivot axis to urge the diaphragm into engagement with the pivot under all operating conditions while imparting to the diaphragm negligible moment to pivot about the pivot means, adjustable leaf spring means mounted to the housing within the first chamber and extending into the first chamber into contact with the diaphragm at a position on the opposite side of the pivot means to the gas inlet and urging the diaphragm to pivot so that the part of the diaphragm on the same side of the pivot means as the gas inlet is moved in a direction to close the gas inlet, and additional leaf spring means mounted to the housing in the second chamber and extending into the second chamber into contact with the diaphragm at a position between the contact with the diaphragm of the apex of the V-shaped leaf spring means and the point of contact with the diaphragm of the adjustable leaf spring means, the adjustable leaf spring means being operative to exert a greater moment about the pivot axis than the additional leaf spring means, whereby the gas inlet is closed at a pressure below atmospheric pressure.

The closing of the gas inlet as a result of pivoting movement of the diaphragm may be effected by the diaphragm being brought into direct contact with a gas inlet jet extending into the first chamber. Alternatively the gas inlet may be closed by the pivoting movement of the diaphragm acting on an intermediate member which in turn closes the gas inlet and stops the flow of gas into the first chamber.

In the embodiment of the present invention which will be described, the gas inlet to the first chamber comprises a gas inlet channel extending between the first chamber and a gas supply channel within the housing, the gas inlet channel includes an orifice connecting the gas inlet channel to the gas supply channel, and a reciprocal needle member is located within the gas inlet channel between the orifice and the first chamber, the needle member comprising a main body adapted for sliding movement within the gas inlet channel and having a diameter smaller than that of the gas inlet channel, permitting passage of gas along the gas inlet channel, past the needle member.

A head and neck extend from the main body of the needle member into the first chamber. A needle head leaf spring means is mounted to the housing in the first chamber and engages the head of the needle member to hold it laterally in line with the center of the gas inlet channel. In this way, the needle member can move up and down, located at the bottom by the location of the needle with the aperture, and located at the top by the leaf spring member channel. At the same time, the head of the needle member is urged continuously into contact with the diaphragm.

The contact of the head portion with the diaphragm, causes the diaphragm to move the needle member and hence the needle into sealing engagement with the aperture when the moments exerted on the diaphragm by the pressure in the first chamber and by the adjustable leaf spring means exceed the moments exerted on the diaphragm by the pressure in the second chamber and by the additional leaf spring means.

Optionally a mechanical means may be fitted to press down on the needle-head leaf spring means to urge the needle into sealing engagement with the aperture, thus allowing a method of closing the valve, independent of diaphragm movement.

The use of the needle member to close the gas inlet avoids contact between the surface of a gas inlet jet extending into the first chamber and the flexible and resilient elastomeric material of the diaphragm which could lead to difficulty in obtaining proper sealing of the jet in the closed position, for which the diaphragm has to be accurately square with the surface of the let in the closed position. Also, with the use of a needle member, there is no danger of any variation of the properties of the elastomeric material with temperature affecting the sealing properties in the closed position of the valve.

In accordance with a further feature a valve in accordance with the present invention additionally includes an over-ride leaf spring secured in the second chamber with the over-ride leaf spring adjacent a wall of the housing defining the second chamber, said wall having an opening therein, and a button slidable in the said opening to contact the over-ride leaf spring and deflect the over-ride leaf spring to move the diaphragm against the action of the adjustable leaf spring means to obtain flow through the valve without a user attempting to draw gas from the valve. This feature may be used for manual override or for testing to give the user confidence that the gas supply is functioning properly.

Although the preferred embodiments of the present invention which will be described employ leaf springs it is, as already indicated, within the scope of the present invention for some or all of the various spring means to be helical or coil springs. When such helical or coil springs are used as the further spring means a pair of such springs is preferably provided, each acting on the diaphragm at a substantial distance from the pivot means.

BRIEF DESCRIPTION OF THE DRAWINGS

The present invention will be better understood from the following detailed description of a preferred embodiment thereof which is made by way of example with reference to the accompanying drawings in which:

FIG. 2 is a plan view of the pilot valve incorporated in the demand valve of FIG. 1 showing the positions of the various leaf springs employed above and below the diaphragm;

FIG. 3 is a plan view similar to FIG. 2 but with the cover and diaphragm removed to show the relative positions of features in the first chamber;

In the drawings the same or similar parts are designated by like reference numerals.

DETAILED DESCRIPTION OF THE PREFERRED EMBODIMENTS

Figure 1:
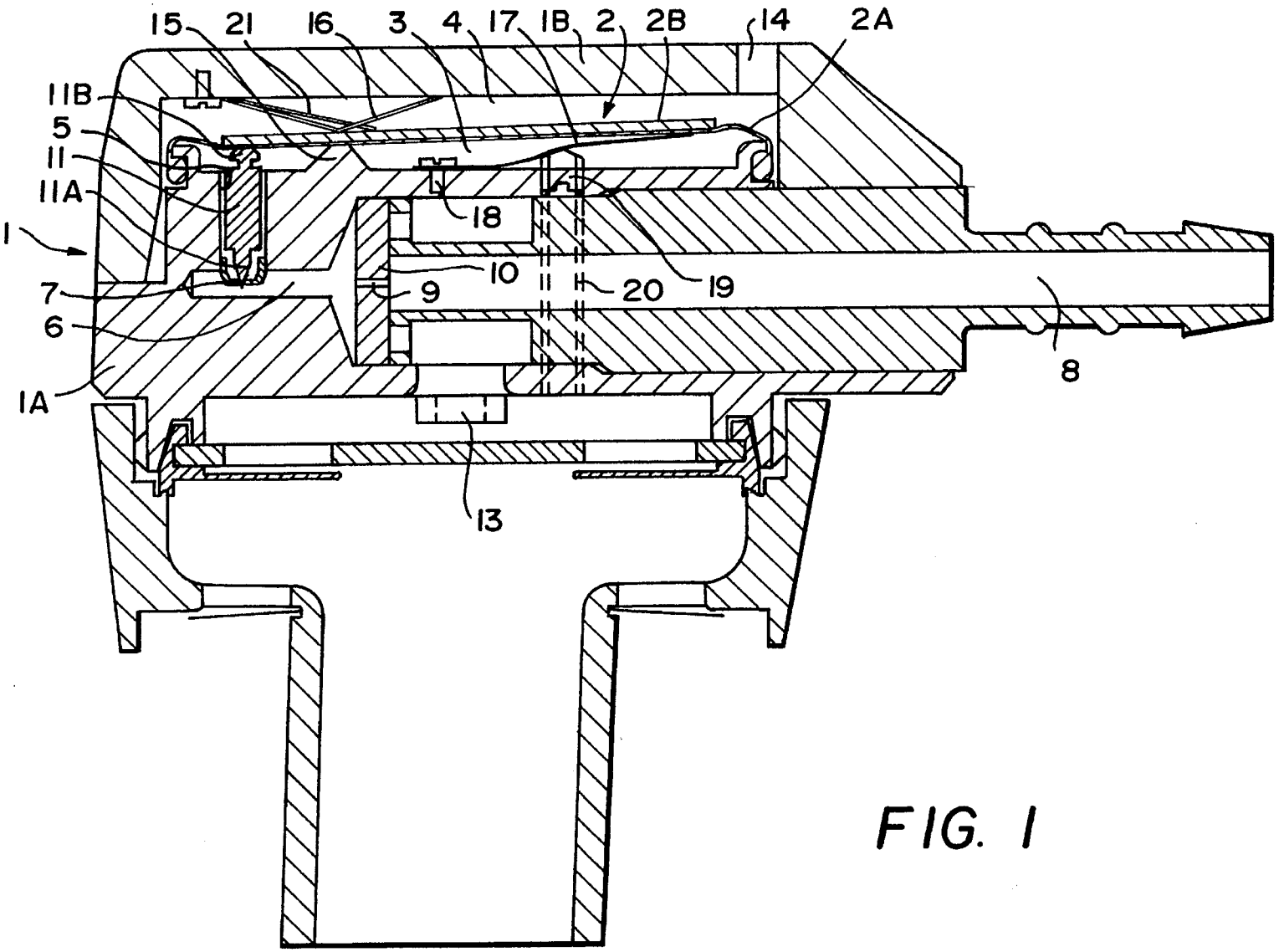
FIG. 1 is a sectional elevation of a negative pressure pilot-operated demand valve in accordance with the present invention employing leaf springs.

Referring to FIGS. 1, 2 and 3 of the accompanying drawings there is shown a pilot-operated demand valve in which the pilot valve is constructed in accordance with the present invention.

The pilot valve comprises a housing 1 consisting of a housing body 1A and a housing cover 1B within which there is mounted a diaphragm 2. The diaphragm 2 is essentially similar to the diaphragm described in the aforesaid U.K. patents and comprises a flexible and resilient material 2A, such as rubber or synthetic plastics material, and a rigid backing plate 2B supporting a greater part of the area of the flexible and resilient material 2A. The term "diaphragm" is used herein to denote the whole assembly of the flexible and resilient material 2A and the rigid backing plate 2B.

The diaphragm 2 is mounted within the housing 1 to define a first chamber 3 on one side of the diaphragm 2 and a second chamber 4 on the other side of the diaphragm 2.

A substantially cylindrical gas inlet channel 5 in a portion of the housing body 1A connects the first chamber 3 with an axial gas supply channel 6 in the housing body 1A through an orifice 7 at the end of the gas inlet channel 5 adjacent to the axial gas supply channel 6. The axial gas supply channel 6 is supplied with gas from a main gas supply channel 8 through a central aperture 9 in a flexible valve member 10 of a main valve.

The gas inlet to the first chamber 3 which is constituted by the orifice 7 and the gas inlet channel 5 may be opened or closed by movement, either out of sealing engagement in the orifice 7 or into such sealing engagement, of a needle 11A at one end of a needle member 11 located in the cylindrical gas inlet channel 5.

At the opposite end to the needle 11A, the needle member 11 has a head 11B which extends into the first chamber 3 and presents a convexly curved surface to the diaphragm 2. The main body of the needle member 11 is cylindrical in shape, and has a diameter smaller than that of the gas inlet channel 5 so as to permit passage of breathing gas from the orifice 7, when open, through the channel 5 past the needle member 11 into the first chamber 3.

The curved surface of the head 11B of the needle member 11 is maintained in contact with the diaphragm 2 in all operating conditions by means of a needle head leaf spring 12 which is used to apply a load upwards under the head 11B of the needle member 11. The leaf spring 12 has a forked end 12A for engaging under the head 11B of the needle member 11 to urge the head 11B continually into contact with the diaphragm 2 is shown in FIG. 3 and in dashed lines in FIG. 2.

A gas outlet 13 (shown in FIG. 3 and in dashed lines in FIG. 2) connects the first chamber 3 to an appropriate means, for example a face mask, for delivering breathing gas to a user.

The second chamber 4 is connected to the ambient atmosphere by a vent 14 in the housing cover 1B and the first chamber 3 further includes two pivot members 15 constituting a pivot means engaging the diaphragm 2 on a pivot axis defined by the line between the tops of the two pivot members 15. The pivot axis lies between the center of gravity of the diaphragm 2 and the gas inlet constituted by the gas inlet channel 5 and the orifice 7.

A pair of v-shaped leaf springs 16 is mounted to the housing cover 1B within the second chamber 4, so that the apex of each v-shaped leaf spring 16 engages the opposite side of the diaphragm 2 to the pivot members 15 along a line which is vertically above the pivot axis. The leaf springs 16 therefore urge the diaphragm 2 to stay on the pivot means while giving the diaphragm 2 a negligible moment to pivot in either direction. Effectively the leaf springs 16 engage the diaphragm 2 along the line of the pivot axis.

The leaf springs 16 apply sufficient loading to ensure that the diaphragm 2 remains in contact with the pivot means 15 under the highest anticipated pressure above atmospheric that may be experienced in the first chamber 3, which is typically the pressure generated on exhalation by a user, for example a patient.

A leaf spring 17 is mounted to the housing body 1A by a screw 18 and extends into the first chamber 3 into contact with the diaphragm 2 at a position near to the edge of the diaphragm 2 on the opposite side of the pivot members 15 to the gas inlet channel 5. Leaf spring 17 urges the diaphragm 2 to pivot about the pivot members 15 to urge the needle member downwardly in the gas inlet channel 5 in a direction to cause the needle 11A to close the orifice 7.

Leaf spring 17 is an adjustable leaf spring, a screw 19 in a tapped hole 20 being provided to bend the leaf spring 17 upwards and exert a greater or lesser force on the diaphragm 2, depending on the position of the screw 19.

Additional leaf spring means is provided in the second chamber 4 in the form of a pair of additional leaf springs 21 which are mounted to the housing cover 1B in positions adjacent to the v-shaped leaf springs 16 so that the ends of the additional leaf springs 21 contact the diaphragm 2 at a small distance to the right of the pivot axis and the contact between the v-shaped leaf springs 16 and the diaphragm 2. The additional leaf springs 21 urge the diaphragm 2 to pivot clockwise to open the gas inlet by allowing the needle 11 to move out of sealing engagement with the orifice 7 in the gas inlet channel 5.

In the preferred embodiment of the invention which is illustrated in the accompanying drawings, the v-shaped leaf springs 16 and the additional leaf springs 21 are combined in a single part comprising a common base member 22 with twin leaf springs 16 and 21 extending from the common base member 22, as shown in FIG. 2. Each leaf spring 16 and each leaf spring 21 is therefore made up of two leaf springs acting in unison.

The adjustable leaf spring 17 and the additional leaf springs 21 are provided to balance the loads on the diaphragm 2 to achieve any required opening pressure, at which the needle 11A of needle member 11 will move out of sealing engagement in the orifice 7 and allow gas to pass through the gas inlet channel 5 to the first chamber 3. The gas inlet closes when the load exerted by the leaf spring 17 is sufficient to overcome the combined moments resulting from the load exerted on the diaphragm by the needle member 11 as a result of the supply pressure and the action of leaf spring 12 (if provided), and by leaf spring 21.

The diaphragm will stay in its closed position until the pressure in the first chamber 3 falls to a level at which the clockwise moment on the diaphragm 2 due to the pressure difference across the diaphragm 2 is sufficient to overcome the resultant moment of the above mentioned forces on the diaphragm 2. This pressure in the first chamber is the opening pressure of the valve. The design and arrangement of the leaf springs 12, 16, 17, and 21 can be adjusted to give a wide range of opening pressures above or below atmospheric pressure.

The association of the pilot valve hereinbefore described with the main valve is the same as that disclosed in the aforesaid corresponding U.K. Patent Application and will not be described in detail.

Figure 4:
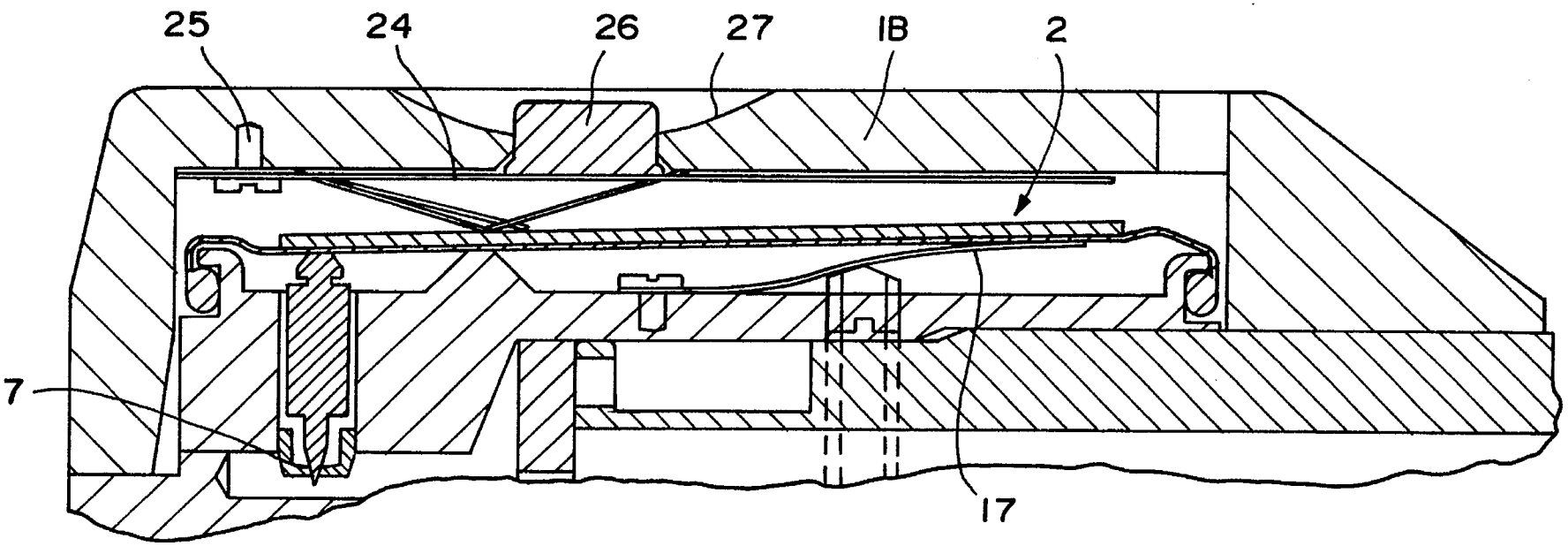
FIG. 4 is an enlarged sectional view of a modified form of part of the valve illustrated in FIG. 1 and additionally incorporating an over-ride feature comprising an over-ride leaf spring and an operating button for test or over-ride purposes.
Figure 5:
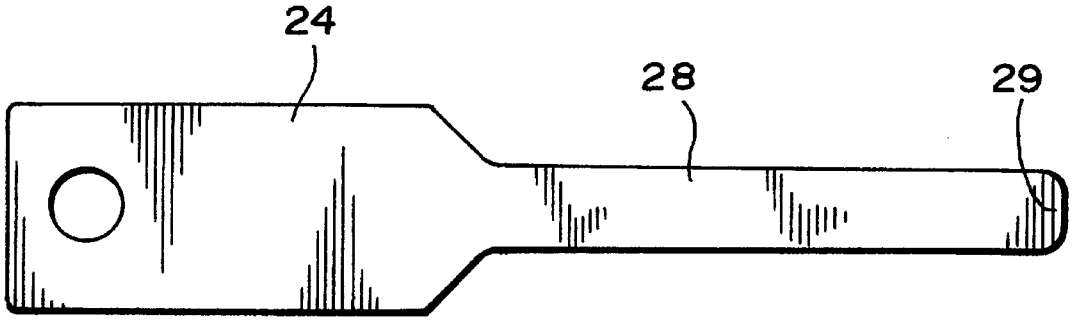
FIG. 5 is a plan view of the leaf spring of FIG. 4.

Referring to FIGS. 4 and 5 of the accompanying drawings there is shown an additional feature which is a test or over-ride mechanism which is incorporated in the second chamber 4 of the valve of FIGS. 1 to 3.

The test or over-ride mechanism comprises essentially an over-ride leaf spring 24 which is mounted in the housing cover 1B by a bolt 25 near one end of the over-ride leaf spring 24 so that the override leaf spring 24 is substantially parallel to the diaphragm 2. A cylindrical button 26 is a sliding fit in an opening through the housing cover 1B, the housing cover 1B being recessed at 27 so that the button 26 may protrude beyond the surface of the housing cover 1B which surrounds the opening without extending through the outer plane of the housing cover 1B with consequential risk of accidental operation.

As shown in FIG. 5 the leaf spring 24 is shaped to have a narrower flexible portion 28 remote from the bolt 25 for easy flexing of the over-ride leaf spring 24 under the action of button 26.

By pressing the button 26 the over-ride leaf spring 24 is caused to bend so that the end 29 of the over-ride leaf spring 24 remote from the bolt 25 comes into contact with the diaphragm 2 and moves the diaphragm 2 against the action of the adjustable leaf spring 17 to permit movement of needle member 11 to open the orifice 7 of the gas inlet and permit gas to flow through the valve either as a simple test or for use in resuscitation or a similar application where breathing gas is to be forced into the lungs of a patient.

It is the use of an over-ride leaf spring 24 as opposed to a compression spring in the test or over-ride mechanism herein described which enables the overall depth of the mechanism including the operating button 26 to fit within the existing profile of the housing 1.

The load applied to the diaphragm by the over-ride leaf spring 24 may be predetermined by appropriate selection of the thickness, length and width of the over-ride leaf spring 24.

The pressure of breathing gas delivered by the valve under test or over-ride conditions will be affected by the characteristics of the over-ride leaf spring. A stiff over-ride leaf spring 24 will provide gas under higher pressure for a given movement of the button 26 than a more flexible over-ride leaf spring. A stiffer over-ride leaf spring is therefore used when a negative pressure demand valve is to be employed in, for example, artificial respiration, and gas is to be forced into the lungs of a patient. A more flexible over-ride leaf spring 24 is all that is required if the button 26 is to be used solely for test purposes.

Because the over-ride leaf spring 24 is flexible between the point of action of the button 26 on the over-ride leaf spring 24 and the point of contact 29 of the over-ride leaf spring 24 with the diaphragm 2, movement of the button 26 gives a progressive opening of the valve rather than a quick switch between off and on positions as would occur if a rigid member was used to act on the diaphragm 2.

The flexibility in the over-ride leaf spring 24 affects the relationship between the movement of the button 26, the stiffness of the button 26 and the load exerted on the diaphragm 2. The flexibility of the narrower section 28 of the over-ride leaf spring 24 has the greater effect on the load exerted on the diaphragm 2, and the flexibility of the wider section of the over-ride leaf spring 24, through which the bolt 25 passes, has the greater effect on the stiffness of the button 26.

The test or over-ride mechanism incorporating an over-ride leaf spring and button as described above has application to other valves than the particular demand valve described and illustrated herein. The test or over-ride mechanism may be used with any valve employing a movable diaphragm to control flow through the valve.

According to this aspect therefore the present invention provides a valve for use in breathing apparatus comprising a housing, a diaphragm mounted within the housing and, together with the housing, defining a first chamber on one side of the diaphragm and a second chamber on the other side of the diaphragm, the second chamber being connected to atmosphere, a gas inlet to the first chamber, a gas outlet from the first chamber, the gas inlet to the first chamber being closed when there is a predetermined pressure in the first chamber and the diaphragm being mounted for movement in response to a decrease of pressure below the predetermined pressure in the first chamber to open the gas inlet to admit gas from a source thereof to the first chamber, an over-ride leaf spring means secured in the second chamber adjacent a wall of the housing defining the second chamber, and a button slidable in an aperture in said wall to contact the over-ride leaf spring and deflect the over-ride leaf spring to move the diaphragm to open the gas inlet to the first chamber in the absence of a pressure lower than the predetermined pressure in the first chamber.

The valve according to this aspect of the present invention may be designed for use in artificial respiration, in which case a relatively stiff over-ride leaf spring is used, or for simple testing purposes, in which case a more flexible over-ride leaf spring may be employed.

The use of an intermediate member to close the gas inlet as hereinbefore described is another feature which has application in other valves than the particular demand valve described and claimed herein. In particular an intermediate member may be used in a valve according to UK Patent No. 2 190 001.

According to this aspect of the present invention there is provided a valve for use in breathing apparatus comprising a housing, a diaphragm mounted within the housing, and, together with the housing, defining first and second chambers on opposite sides of the diaphragm, a gas inlet to the first chamber which comprises a gas inlet channel extending within the housing between the first chamber and a gas supply channel, an orifice in the gas inlet channel permitting a restricted flow of gas from the gas supply channel to the gas inlet channel, and an intermediate member located in the gas inlet channel between the orifice and the first chamber, the intermediate member comprising a main body adapted for sliding movement within the gas inlet channel but permitting passage of gas along the gas inlet channel past the main body, a sealing device projecting from the main body adjacent to the orifice and movable into and out of sealing engagement with the orifice, and a head extending from the main body into the first chamber, a gas outlet from the first chamber, vent means in the housing connecting the second chamber to a reference pressure, and pivot means in one of said first and second chambers for engaging the diaphragm on a pivot axis between the center of gravity of the diaphragm and the gas inlet, the arrangement being such that, when the pressure in the first chamber exceeds the reference pressure or a pressure in a predetermined relation to the reference pressure, the diaphragm pivots about the pivot axis to close the gas inlet by acting on the head of the intermediate member to move the main body of the intermediate member in the gas inlet channel until the sealing device is in sealing engagement with the orifice.

The intermediate member is preferably a needle member as herein disclosed having a needle as the sealing device which is movable into and out of sealing engagement with the orifice. However other sealing devices may be employed, for example a ceramic ball. If the orifice is formed in a raised seat, for example a frustum, the sealing device may be a suitable flat surface.

FIG. 1 of the accompanying drawings shows the valve of the present invention used as part of a pilot-operated demand valve in association with an inhale valve which is the subject of our co-pending European Patent Application No. 0582419.

I claim:

1. A valve for use in breathing apparatus comprising a housing, a diaphragm, having a center of gravity, mounted within the housing and, together with the housing, defining a first chamber on one side of the diaphragm and a second chamber on an opposing side of the diaphragm, a gas inlet to the first chamber, a gas outlet from the first chamber, vent means in the housing connecting the second chamber to ambient atmosphere, pivot means in the first chamber for engaging the diaphragm on a pivot axis between the center of gravity of the diaphragm and the gas inlet, first spring means mounted to the housing within the second chamber and extending into engagement with the opposing side of the diaphragm to the pivot means and applying to the diaphragm a force directed toward the pivot axis to maintain the diaphragm in engagement with the pivot means, and further spring means mounted to the housing and extending into the first chamber into contact with the diaphragm at a position opposite the pivot means to the gas inlet and urging the diaphragm to pivot so that part of the diaphragm on the same side of the pivot means as the gas inlet is moved in a direction to close the gas inlet whereby the gas inlet is closed by the diaphragm at a pressure below atmospheric pressure.

2. A valve according to claim 1 further comprising adjustment means for adjusting the further spring means to vary the moment about the pivot exerted by the further spring means.

3. A valve according to claim 1 wherein the first spring means is first leaf spring means.

4. A valve according to claim 1 wherein the further spring means is a leaf spring means.

5. A valve according to claim 1 including additional spring means mounted to the housing within the second chamber and extending into contact with the diaphragm at a position on the opposite side of the pivot means from the gas inlet.

6. A valve according to claim 5 wherein the additional spring means comprises additional leaf spring means.

7. A valve according to claim 5 wherein the first spring means and the additional spring means are combined in a single part comprising a common base member and two twin leaf springs extending therefrom, one twin leaf spring being the first spring means and the other twin leaf spring being the additional spring means.

8. A valve according to claim 1 which is a demand valve.

9. A valve according to claim 1 which is a pilot valve controlling a main valve.

10. A valve for use in breathing apparatus comprising a housing, a diaphragm, having a center of gravity, mounted within the housing and, together with the housing, defining a first chamber on one side of the diaphragm and a second chamber on an opposing side of the diaphragm, a gas inlet to the first chamber, a gas outlet from the first chamber, vent means in the housing connecting the second chamber to ambient atmosphere, pivot means in the first chamber for engaging the diaphragm on a pivot axis between the center of gravity of the diaphragm and the gas inlet, V-shaped leaf spring means mounted to the housing within the second chamber such that the apex of the V-shaped leaf spring means contacts the diaphragm at a position in the second chamber opposite to the pivot axis to urge the diaphragm into engagement with the pivot under all operating conditions while imparting to the diaphragm negligible moment to pivot about the pivot means, adjustable leaf spring means mounted to the housing within the first chamber and extending into the first chamber into contact with the diaphragm at a position opposite the pivot means to the gas inlet and urging the diaphragm to pivot so that part of the diaphragm on the same side of the pivot means as the gas inlet is moved in a direction to close the gas inlet, and additional leaf spring means mounted to the housing in the second chamber and extending into the second chamber into contact with the diaphragm at a position between the contact with the diaphragm of the apex of the V-shaped leaf spring means and the point of contact with the diaphragm of the adjustable leaf spring means, the adjustable leaf spring means being operative to exert a greater moment about the pivot axis than the additional leaf spring means, whereby the gas inlet is closed at a pressure below atmospheric pressure.

11. A valve according to claim 10 wherein the gas inlet to the first chamber comprises a gas inlet channel extending between the first chamber and a gas supply channel within the housing, the gas inlet channel includes an orifice connecting the gas inlet channel to the gas supply channel, and a reciprocal needle member is located within the gas inlet channel between the orifice and the first chamber, the needle member comprising a main body adapted for movement along the channel but permitting passage of gas along the gas inlet channel past the main body, a needle located on the main body adjacent to the orifice and movable into and out of sealing engagement with the orifice, and a head extending from the main body into the first chamber into contact with the diaphragm whereby the diaphragm causes the needle member to move the needle into sealing engagement with the orifice when the moments exerted on the diaphragm by the pressure in the first chamber and by the adjustable leaf spring means exceed the moments exerted on the diaphragm by the pressure in the second chamber and by the additional leaf spring means.

12. A valve according to claim 11 wherein there is further provided needle head leaf spring means which is mounted to the housing in the first chamber and which engages the head of the needle member to urge the head of the needle member continuously into contact with the diaphragm.

13. A valve according to any one of claim 10 further including an over-ride leaf spring secured in the second chamber with the over-ride leaf spring adjacent a wall of the housing defining the second chamber, said wall having an opening therein and a button slidable in the said opening to contact the over-ride leaf spring and deflect the over-ride leaf spring to move the diaphragm against the action of the adjustable leaf spring means to obtain flow through the valve without a user attempting to draw gas from the valve.

14. A valve for use in breathing apparatus comprising a housing, a diaphragm, having a center of gravity, mounted within the housing, and, together with the housing, defining first and second chambers on opposite sides of the diaphragm, a gas inlet to the first chamber which comprises a gas inlet channel extending within the housing between the first chamber and a gas supply channel, an orifice in the gas inlet channel permitting a restricted flow of gas from the gas supply channel to the gas inlet channel, and an intermediate member located in the gas inlet channel between the orifice and the first chamber, the intermediate member comprising a main body adapted for sliding movement within the gas inlet channel but permitting passage of gas along the gas inlet channel past the main body, a sealing device projecting from the main body adjacent to the orifice and movable into and out of sealing engagement with the orifice, and a head extending from the main body into the first chamber, a gas outlet from the first chamber, vent means in the housing connecting the second chamber to a reference pressure, and pivot means in one of said first and second chambers for engaging the diaphragm on a pivot axis between the center of gravity of the diaphragm and the gas inlet, the arrangement being such that, when the pressure in the first chamber exceeds the reference pressure or a pressure in a predetermined relation to the reference pressure, the diaphragm pivots about the pivot axis to close the gas inlet by acting on the head of the intermediate member to move the main body of the intermediate member in the gas inlet channel until the sealing device is in sealing engagement with the orifice.

15. A valve according to claim 14 wherein the pivot means is located in the second chamber.

16. A valve according to claim 15 wherein the vent means connects the second chamber to ambient atmosphere, and the diaphragm pivots to close the gas inlet at a predetermined pressure above atmospheric pressure.

17. A valve according to claim 14 wherein the pivot means is located in the first chamber.

18. A valve for use in breathing apparatus comprising a housing, a diaphragm, having a center of gravity, mounted within the housing, and, together with the housing, defining first and second chambers on opposite sides of the diaphragm, a gas inlet to the first chamber which comprises a gas inlet channel extending within the housing between the first chamber and a gas supply channel, an orifice in the gas inlet channel permitting a restricted flow of gas from the gas supply channel to the gas inlet channel, and a needle member located in the gas inlet channel between the orifice and the first chamber, the needle member comprising a main body adapted for sliding movement within the gas inlet channel but permitting passage of gas along the gas inlet channel past the main body, a needle projecting from the main body adjacent to the orifice and movable into and out of sealing engagement with the orifice, and a head extending from the main body into the first chamber, a gas outlet from the first chamber, vent means in the housing connecting the second chamber to a reference pressure, and pivot means in one of said first and second chambers for engaging the diaphragm on a pivot axis between the center of gravity of the diaphragm and the gas inlet, the arrangement being such that, when the pressure in the first chamber exceeds the reference pressure or a pressure in a predetermined relation to the reference pressure, the diaphragm pivots about the pivot axis to close the gas inlet by acting on a head of the needle member to move the needle member in the gas inlet channel until the needle is in sealing engagement with the orifice.

* * * * *